US007367299B2

(12) United States Patent
Vaseleniuck

(10) Patent No.: US 7,367,299 B2
(45) Date of Patent: May 6, 2008

(54) VARIABLE RATIO ROCKER ASSEMBLY

(76) Inventor: David N. Vaseleniuck, 4387 Racing Dr., Denver, NC (US) 28037-6214

( * ) Notice: Subject to any disclaimer, the term of this patent is extended or adjusted under 35 U.S.C. 154(b) by 0 days.

(21) Appl. No.: 11/619,403

(22) Filed: Jan. 3, 2007

(65) Prior Publication Data

US 2007/0151532 A1 Jul. 5, 2007

Related U.S. Application Data

(60) Provisional application No. 60/756,154, filed on Jan. 4, 2006.

(51) Int. Cl.
*F01L 1/34* (2006.01)

(52) U.S. Cl. ..... 123/90.16; 123/90.39; 123/90.41

(58) Field of Classification Search ..... 123/90.16, 123/90.39, 90.41
See application file for complete search history.

(56) References Cited

U.S. PATENT DOCUMENTS 2,880,711 A * 4/1959 Roan ..... 123/90.16
4,387,673 A * 6/1983 Aoyama et al. ..... 123/90.16
5,560,265 A * 10/1996 Miller ..... 74/559

OTHER PUBLICATIONS

Taylor, "The Internal-Combustion Engine in Theory and Practice," vol. 1, p. 178 (2nd edition, The MIT Press 1998).

Ferguson, "Internal Combustion Engines," p. 14 and 247 (John Wiley & Sons 1986).

* cited by examiner

*Primary Examiner*—Zelalem Eshete
(74) *Attorney, Agent, or Firm*—Trego, Hines & Ladenheim, PLLC

(57) ABSTRACT

A variable ratio rocker assembly for increasing the amount of air entering a combustion cylinder. The rocker assembly includes a rocker arm adapted to move a valve between a closed position and an open position, a radiused follower adapted to interact with a portion of the rocker arm, and a push rod for moving the follower in response to a camshaft. The follower causes the rocker arm to move the valve between the closed position and the open position.

20 Claims, 10 Drawing Sheets

VARIABLE RATIO ROCKER ASSEMBLY

CROSS-REFERENCE TO RELATED APPLICATIONS

This application claims the benefit of Provisional Application No. 60/756,154, filed on Jan. 4, 2006.

TECHNICAL FIELD AND BACKGROUND OF THE INVENTION

The present invention relates to the field of internal combustion engines. In particular, the invention relates to a rocker assembly that provides a variable lift ratio to increase the amount of air entering the combustion cylinder.

Rocker assemblies are well-known in the field of internal combustion engines. Rocker assemblies are responsible for opening and closing intake and exhaust valves in a cylinder head of an engine. Opening of the intake valve allows air to enter the combustion chamber of an engine to provide combustion air for the combustion process. The combustion air is mixed with fuel in the combustion chamber where the mixture is compressed and ignited by a spark plug, or in the case of a diesel engine by the pressure and temperature associated with the compression stage. Once the mixture has been ignited, the combustion of the mixture forces the piston down the cylinder away from the combustion chamber to create a stroke. The gases formed by igniting the mixture are then evacuated from the combustion chamber through an opened exhaust valve.

Performance and efficiency of an engine is related to the amount of air that can be drawn by the intake valve into the combustion chamber, as well as the amount of gas that can be evacuated out of the combustion chamber through the exhaust valves. One approach for increasing air flow into and out of a combustion chamber is to increase the amount of valve lift of the valves. This can be done be replacing the existing rocker arms with higher ratio rocker arms or by replacing the cam with a cam having a steeper lift curve, i.e., a more "aggressive" cam.

Rocker arms multiply the lift provided by a lobe of a camshaft. Increasing the ratio of the rocker arm, increases the multiplication factor. Thus, more air can be drawn into or evacuated out of the combustion chamber, but the aggressiveness of the valve lift is not altered by the higher ratio rocker arms.

Replacing the camshaft with a more aggressive camshaft also increases the lift of the valves. By changing the profile of the lobes on the camshaft, the amount of valve lift and the aggressiveness of that lift can be changed. However, mechanical allowances prevent camshafts from being too aggressive. Additionally, aggressive camshafts are less reliable.

Accordingly, there is a need for a rocker assembly that provides the advantages of both current rocker arms and camshafts without the disadvantages or limitations associated with each.

SUMMARY OF THE INVENTION

Therefore, it is an object of the invention to provide a rocker assembly that provides a variable lift ratio.

It is another object of the invention to provide a rocker assembly that increases air flow into and out of a combustion chamber.

It is another object of the invention to provide a rocker assembly that can change the valve lift curve.

It is another object of the invention to provide a rocker assembly that increases fuel efficiency.

It is another object of the invention to provide a rocker assembly that increases durability.

It is another object of the invention to provide a rocker assembly that provides a smoother running engine.

These and other objects of the present invention are achieved in the preferred embodiments disclosed below by providing a variable ratio rocker assembly including a rocker arm adapted to move a valve between a closed position and an open position; a radiused follower adapted to interact with a portion of the rocker arm, wherein the follower causes the rocker arm to move the valve between the closed position and the open position; and a push rod for moving the follower in response to a camshaft.

According to another preferred embodiment of the invention, the rocker arm includes a roller on a first free end of the rocker arm for interacting with a stem of the valve to reduce friction between the rocker arm and the valve when moving the valve between the closed position and the open position.

According to another preferred embodiment of the invention, the rocker arm includes a trunnion positioned between a first free end and a second free end of the rocker arm for pivotally supporting the rocker arm on a rocker bar.

According to another preferred embodiment of the invention, the rocker assembly further includes a rocker stand for supporting the rocker bar.

According to another preferred embodiment of the invention, the follower is pivotally connected to the rocker stand.

According to another preferred embodiment of the invention, the rocker arm includes a second free end having a radiused bottom.

According to another preferred embodiment of the invention, a top of the follower interacts with the bottom of the second free end to provide a variable lift ratio to the rocker arm.

According to another preferred embodiment of the invention, the top of the follower has a convex curvature.

According to another preferred embodiment of the invention, the follower includes a receiving cup for receiving an end of the push rod.

According to another preferred embodiment of the invention, the rocker assembly further includes a linkage for connecting the rocker arm to the follower.

According to another preferred embodiment of the invention, a first end of the linkage is connected to a trunnion of the rocker arm and a second end of the linkage is connected to the follower to allow the follower and rocker arm to move relative to each other.

According to another preferred embodiment of the invention, the follower is a swing arm.

According to another preferred embodiment of the invention, the follower is a lifter.

According to another preferred embodiment of the invention, a variable ratio rocker assembly includes a pushrod, a follower actuated by the pushrod in response to a camshaft, and a rocker arm actuated by the follower for moving a valve between a closed position and an open position. The follower includes a radiused top for interacting with a bottom of a second free end of the rocker arm such that actuation of the follower causes a first free end of the rocker arm to actuate the valve.

According to another preferred embodiment of the invention, the rocker arm includes a trunnion positioned between the first free end and the second free end of the rocker arm to allow the rocker arm to pivot about a support.

According to another preferred embodiment of the invention, the follower is pivotally connected to a support.

According to another preferred embodiment of the invention, the bottom of the rocker arm is radiused.

According to another preferred embodiment of the invention, interaction between the top of the follower and the bottom of the second free end creates a variable lift ratio.

According to another preferred embodiment of the invention, the rocker assembly further includes a linkage for connecting the rocker arm to the follower. A first end of the linkage is connected to the trunnion of the rocker arm and a second end of the linkage is connected to the follower to allow the follower and rocker arm to move relative to each other.

According to another preferred embodiment of the invention, a variable ratio rocker assembly includes a rocker arm adapted to move a valve between a closed position an open position. The rocker arm is mounted for pivotal movement about a support and includes a first free end for actuating the valve, and a second free end having a convex bottom portion. The rocker assembly further includes a follower having a convex top portion adapted to interact with the convex bottom portion to provide a variable lift ratio to the rocker arm, and a push rod for moving the follower such that the convex top portion moves along the convex bottom portion. Movement of the top portion along the bottom portion causes the rocker arm to pivot about the support and allows the first free end to move the valve between the closed position and the open position.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
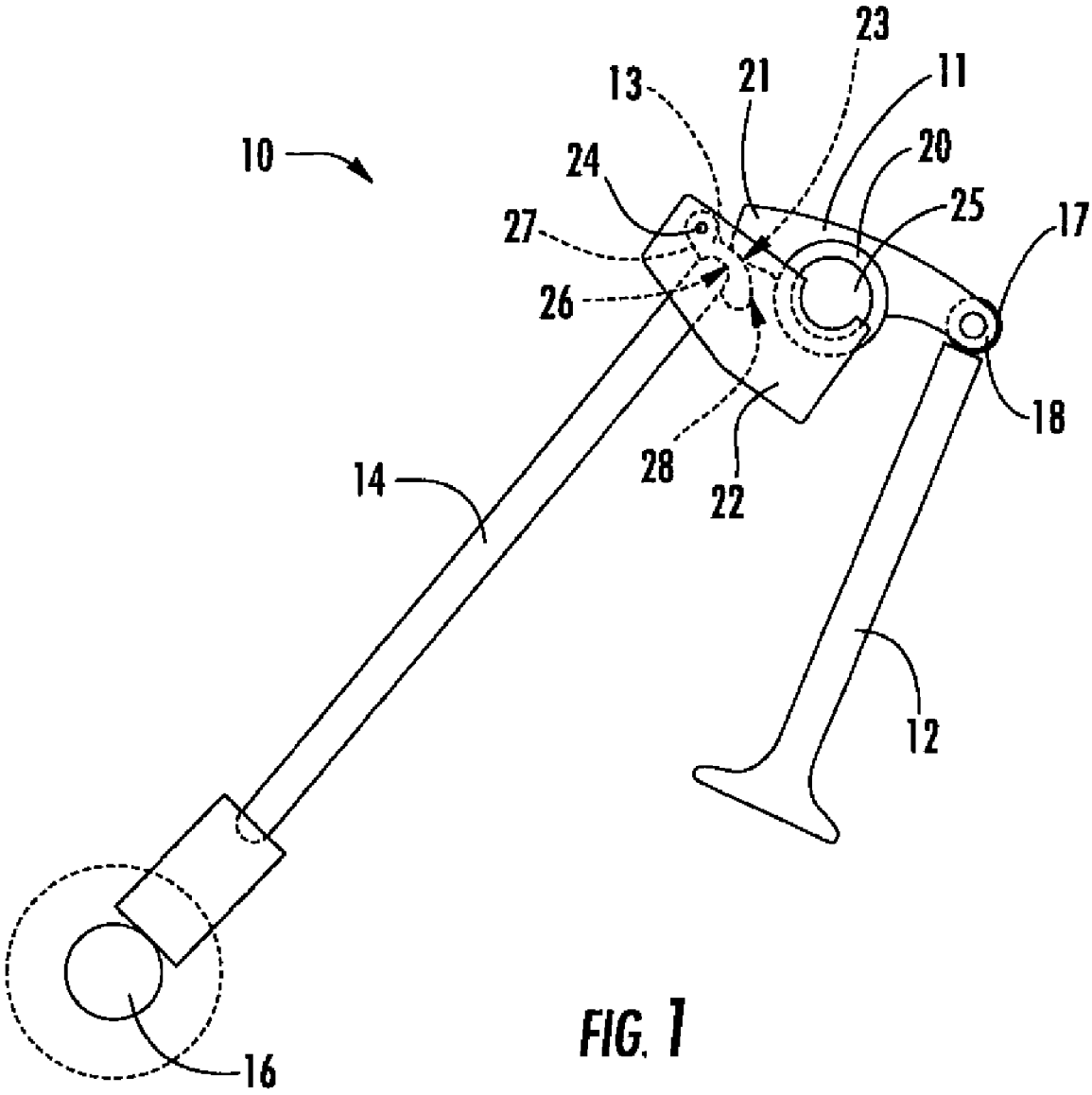
FIG. 1 shows a rocker assembly according to an embodiment of the invention.

Referring now specifically to the drawings, a rocker assembly according to an embodiment of the invention is illustrated in FIG. 1 and shown generally at reference numeral 10. The rocker assembly 10 includes a rocker arm 11 for moving a valve 12, a radiused follower, such as a swing arm 13, for moving the rocker arm 11, and a push-rod 14 for moving the swing arm 13. The push-rod 14 is moved by a camshaft 16.

Figure 2:
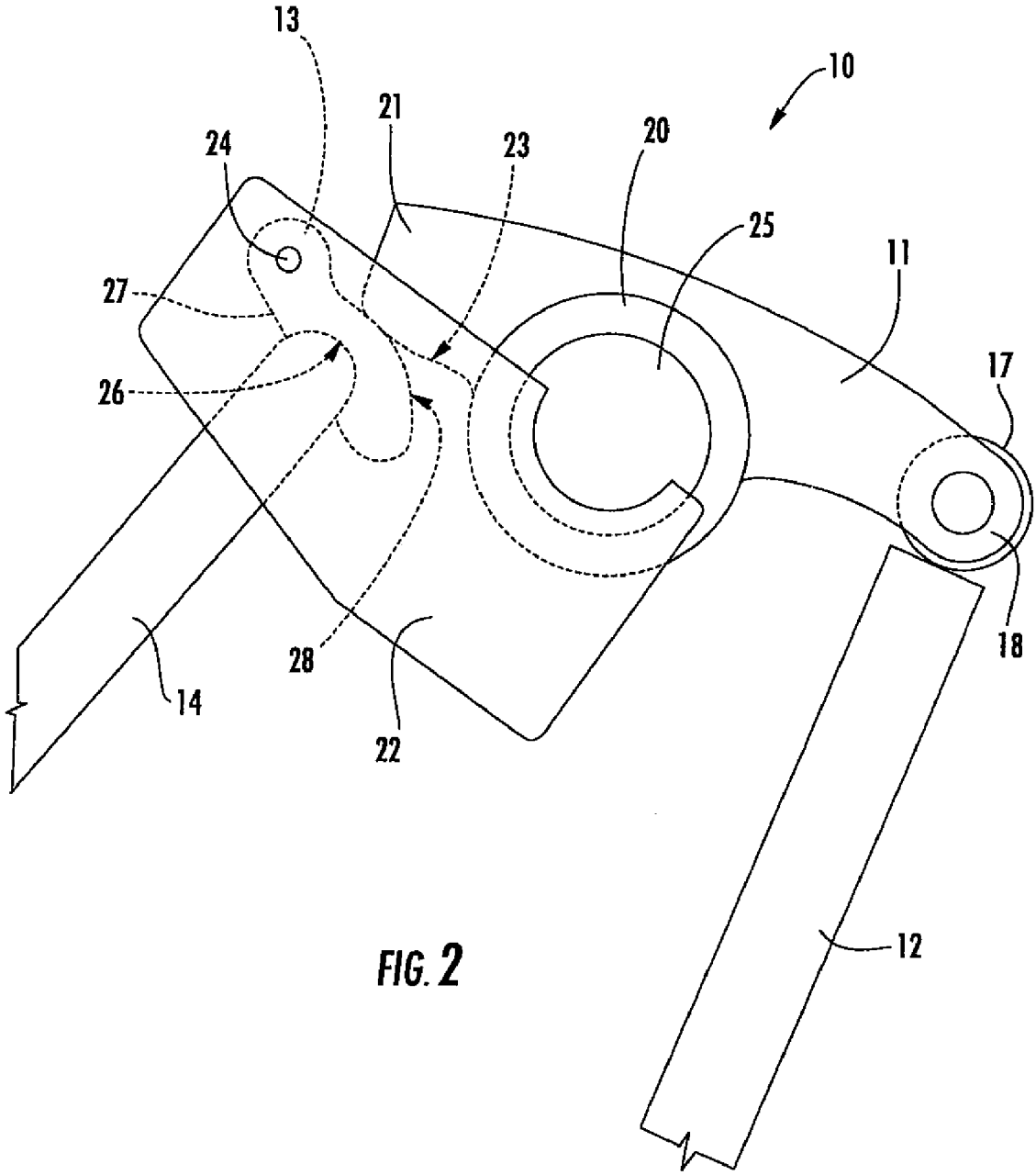
FIG. 2 shows the rocker assembly of FIG. 1 at zero lift.

As shown in FIG. 2, the rocker arm 11 includes a roller 17 positioned on a first free end 18 of the rocker arm 11. The roller 17 rolls along the end of the valve's 12 stem, to reduce friction, as it moves the valve 12 from a closed position to an open position. A rocker arm without a roller may also be used. The rocker arm 11 further includes a trunnion 20 positioned between the first free end 18 and a second free end 21 of the rocker arm 11. The trunnion 20 pivotally supports the rocker arm 11 on a rocker bar 25 extending therethrough, which is supported by a rocker stand 22.

A bottom edge 23 of the second free end 21 has a convex curvature adapted to interact with the swing arm 13. The radius of the bottom edge 23 may be any suitable radius for interacting with the swing arm 13. The swing arm 13 is pivotally connected to the rocker stand 22 by a pin 24 to allow the push-rod 14 to move the swing arm 13 about the pin 24, thereby causing the rocker arm to pivot about the rocker bar 25 and move the valve 12 from a closed position to an open position.

A receiving cup 26 is positioned in a bottom 27 of the swing arm 13 for receiving the push-rod 14. A top 28 of the swing arm 13 has a convex curvature to interact with the bottom edge 23 of the rocker arm 11. The radius of the top 28 and bottom edge 23 cooperate to provide a variable lift for the valve 12. By changing the radius of the top 28 and/or the radius of the bottom edge 23, the valve lift curve for the rocker arm 11 can be changed. For example, the radius of the top 28 may be made to provide an aggressive valve lift profile or a smooth valve lift profile. It may also be made to provide a combination valve lift profile, where the opening is aggressive and the closing is smooth. Thus, an aggressive valve lift curve can be obtained without using an aggressive camshaft. This increases durability and eliminates any mechanical allowance problems associated with camshafts having an aggressive profile. If an aggressive camshaft is used, the radius of the top 28 can be used to provide an even more aggressive valve lift profile, thereby obtaining a valve lift profile otherwise unattainable due to mechanical allowances.

Figure 3:
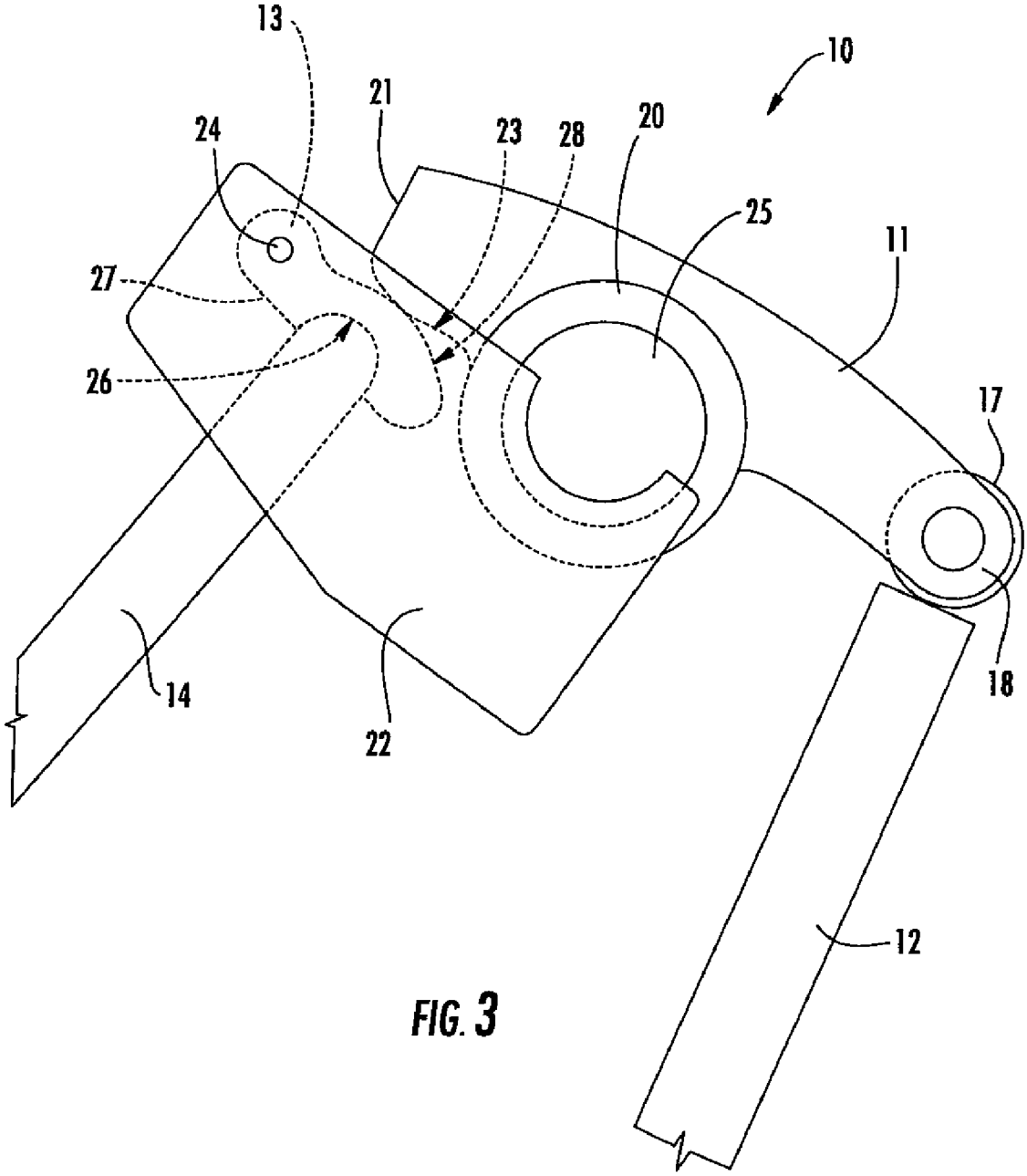
FIG. 3 shows the rocker assembly of FIG. 1 at first intermediate lift.
Figure 4:
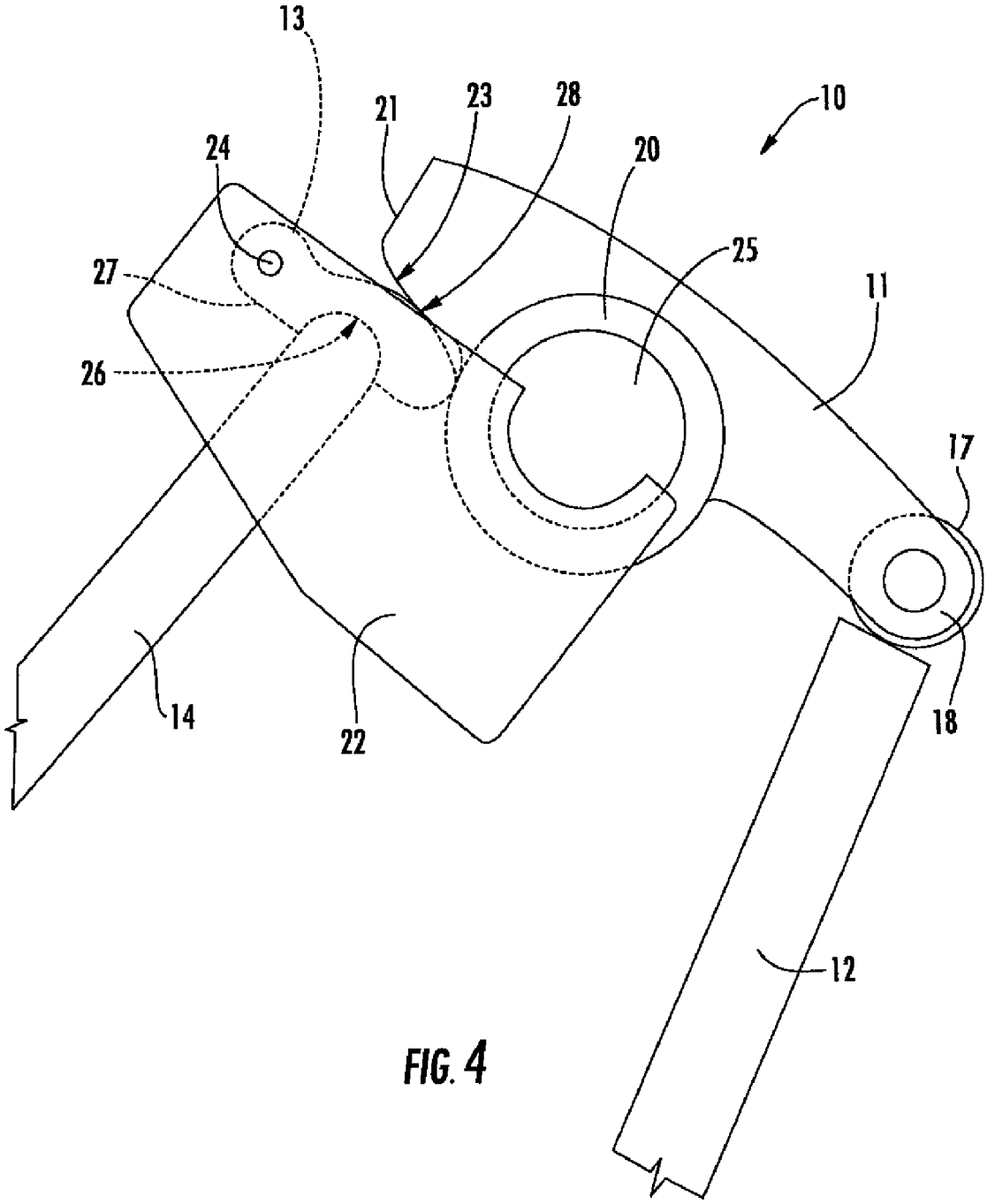
FIG. 4 shows the rocker assembly of FIG. 1 at second intermediate lift.
Figure 5:
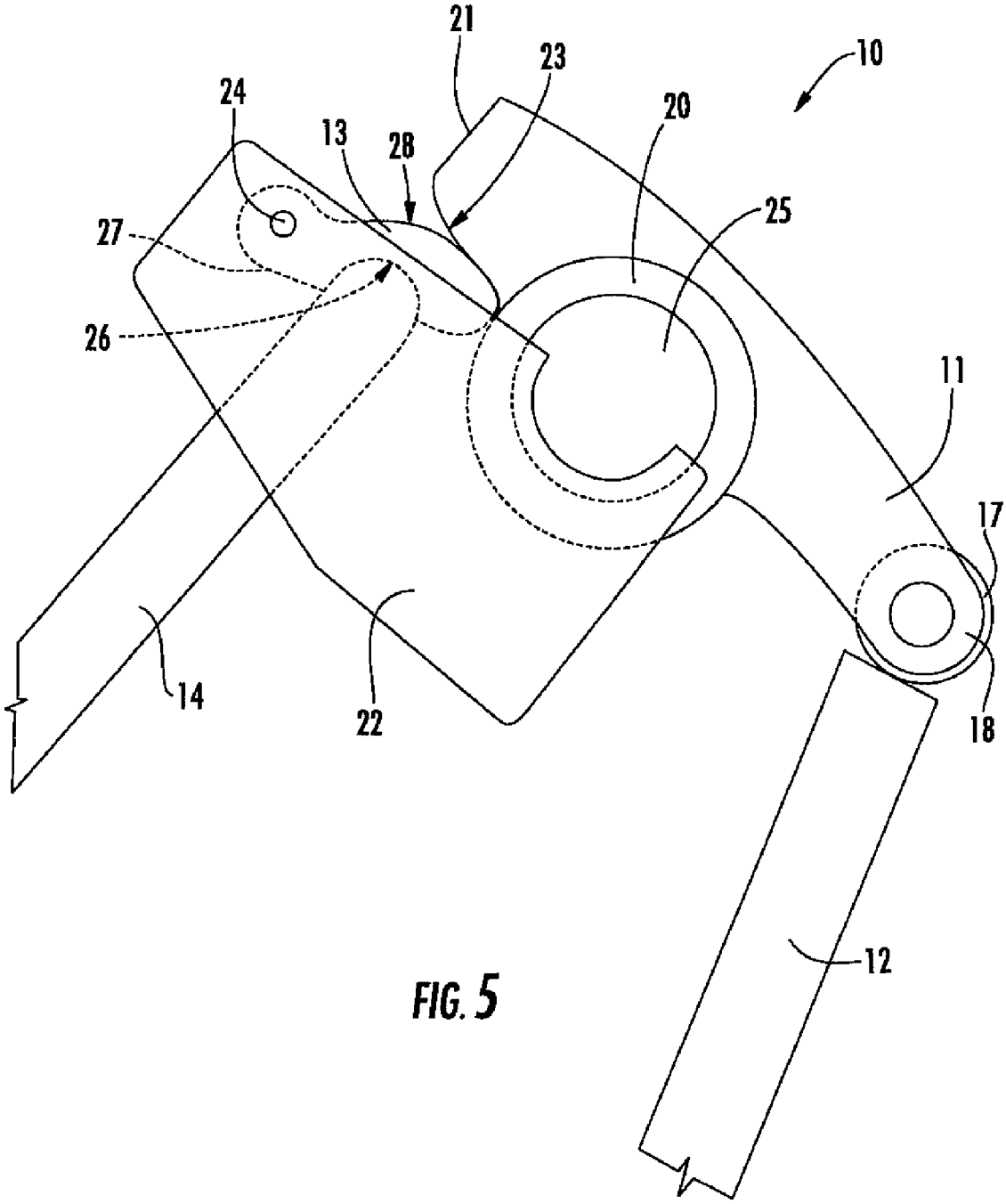
FIG. 5 shows the rocker assembly of FIG. 1 at third intermediate lift.

Referring now to FIGS. 2-6, as the push-rod 14 is moved in an upward direction by the camshaft 16, the swing arm 13 interacts with the rocker arm 11 to move the valve 12 from a closed position to an open position. As shown, the top 28 of the swing arm 13 cooperates with the bottom edge 23 of the rocker arm 11 to provide a variable lift to the valve 12. As the push-rod 14 moves upwardly, the contact area between the top 28 and the bottom edge 23 moves along the radius of the top 28 and bottom edge 23 from a zero lift position, shown in FIG. 2, to a maximum lift position, shown in FIG. 6. As shown in FIGS. 3-5, the contact area between the top 28 and the bottom edge 23 moves gradually from left to right as the push-rod 14 moves upwardly from zero lift to maximum lift. The lift values associated with the upward movement of the push-rod change throughout the movement, and are dependent on the profile of the top 28 and bottom edge 23. Examples of rocker arm ratios and valve lift values occurring with reference to the figures are as follows:

FIG. 2—zero lift; ratio=1.6

FIG. 3—2.54 mm (0.100 inches) of lift; ratio=1.8

FIG. 4—5.08 mm (0.200 inches) of lift; ratio=1.93

Figure 6:
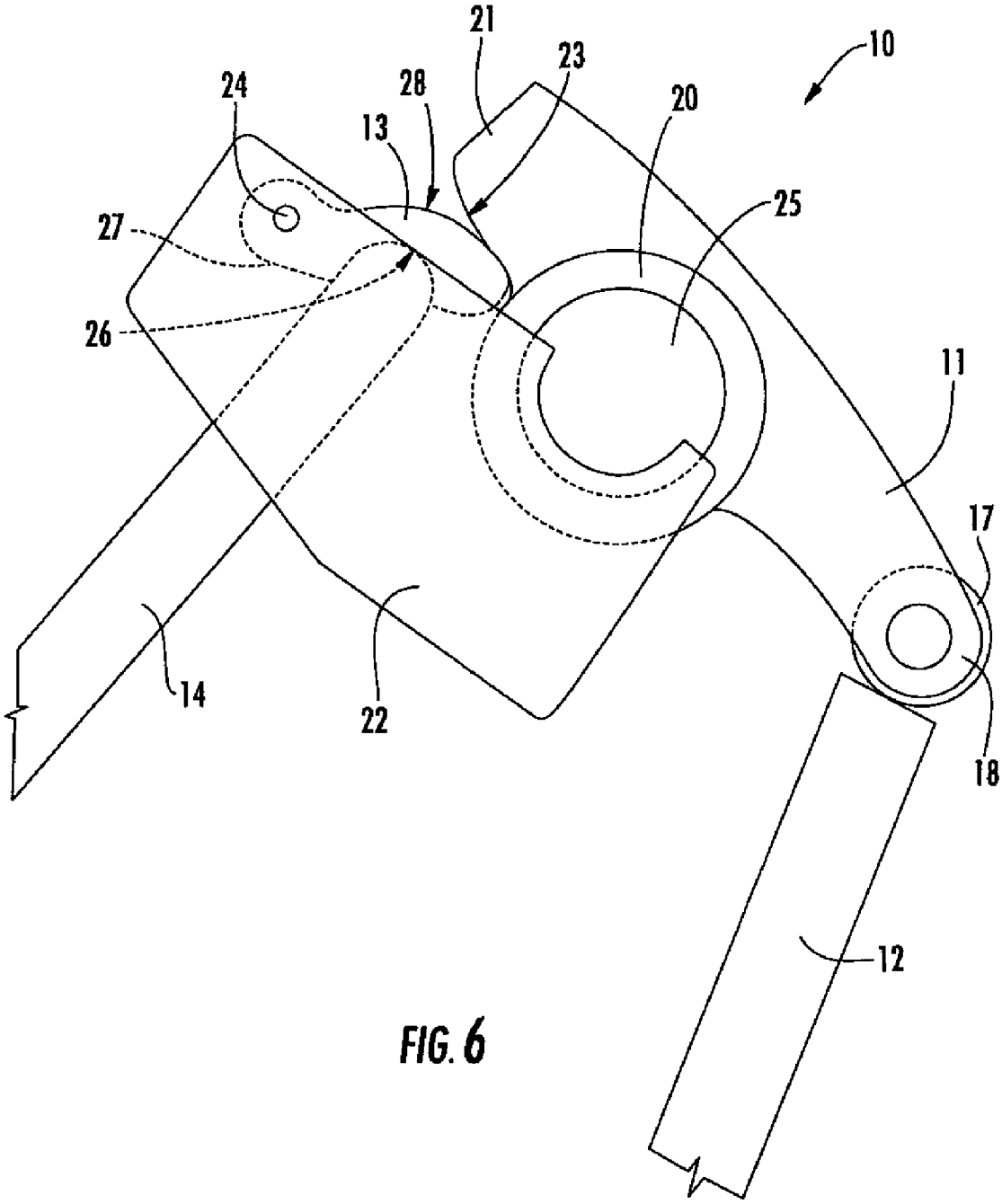
FIG. 6 shows the rocker assembly of FIG. 1 at maximum lift.
Figure 7:
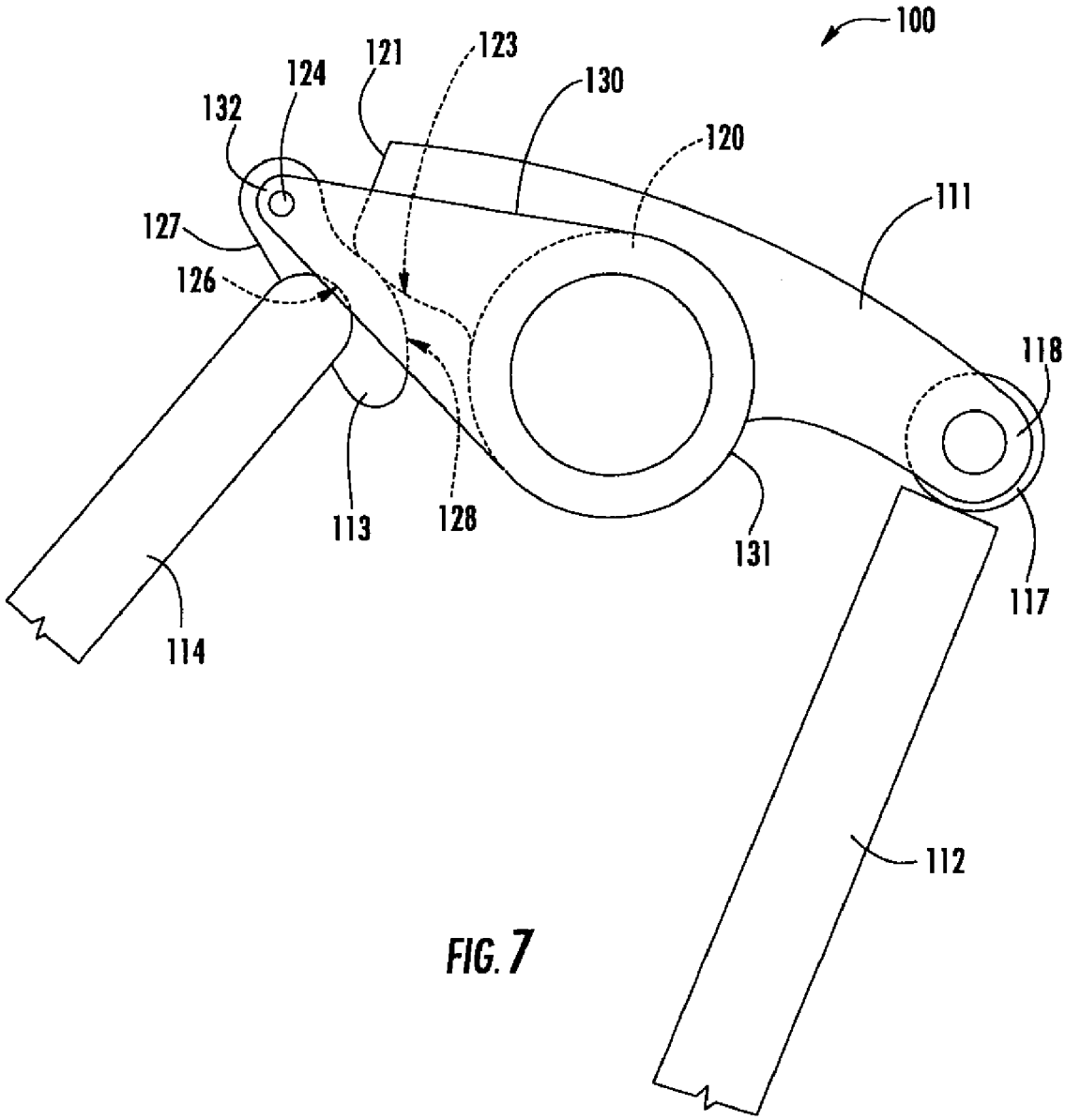
FIG. 7 shows a rocker assembly according to another embodiment of the invention at zero lift.

FIG. 5—7.62 mm (0.300 inches) of lift; ratio=2.05

Figure 8:
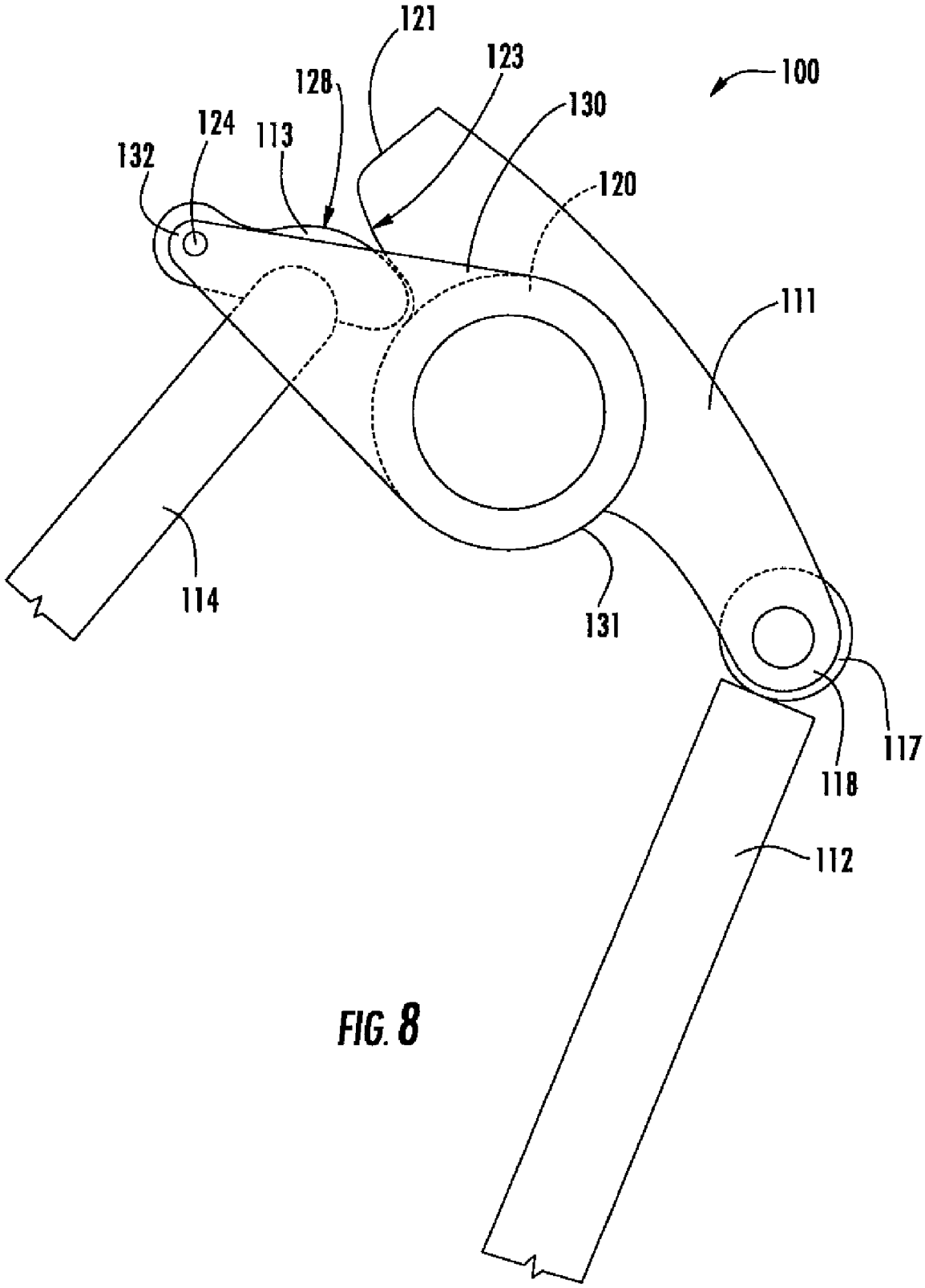
FIG. 8 shows the rocker assembly of FIG. 7 at maximum lift.

FIG. 6—8.89 mm (0.350 inches) of lift; ratio=2.11.

Illustrated in FIGS. 7 and 8, a rocker assembly according to another embodiment of the invention is shown at reference numeral 100. Like rocker assembly 10, the rocker assembly 100 includes a rocker arm 111, a swing arm 113, and a push-rod 114. The rocker arm 111 is of the studdedtype and includes a roller 117 positioned on a first free end 118 to reduce friction as it moves a valve from a closed position to an open position, and a trunnion 120 positioned between the first free end 118 and a second free end 121. A rocker arm without a roller may also be used.

A linkage 130 connects the rocker arm 111 to the swing arm 113. The linkage 130 is connected to the trunnion 120 of the rocker arm 111 at a first end 131 of the linkage 130 and to the swing arm 113 by a pin 124 at a second end 132. As shown, the linkage 130 allows the rocker arm 111 and swing arm 113 to pivot, but remains stationary during the lifting of the rocker arm 111.

Like the rocker arm 11, a bottom edge 123 of the second free end 121 has a convex curvature adapted to interact with the swing arm 113. A receiving cup 126 is positioned in a bottom 127 of the swing arm 113 for receiving the push-rod 114. A top 128 of the swing arm 113 has a convex curvature to interact with the bottom edge 123 of the rocker arm 111. The radius of the top 128 and bottom edge 123 cooperate to provide a variable lift for the valve 112.

The rocker assembly 100 operates in the same manner as the rocker assembly 10. As shown, the push-rod 114 causes the swing arm 113 to variably lift the rocker arm 111 from a zero lift position, FIG. 7, to a maximum lift position, FIG. 8.

Figure 9:
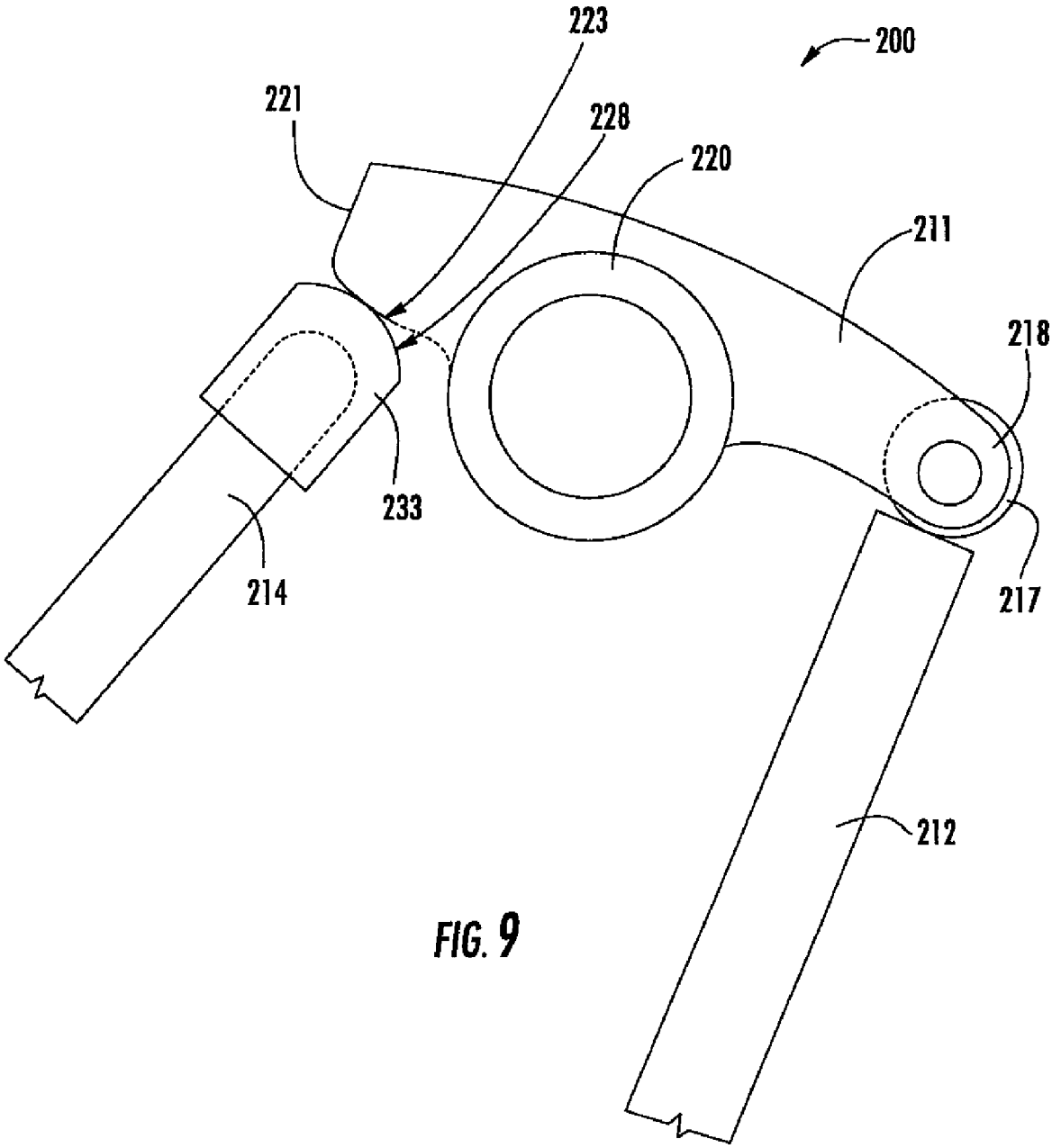
FIG. 9 shows a rocker assembly according to another embodiment of the invention at zero lift.
Figure 10:
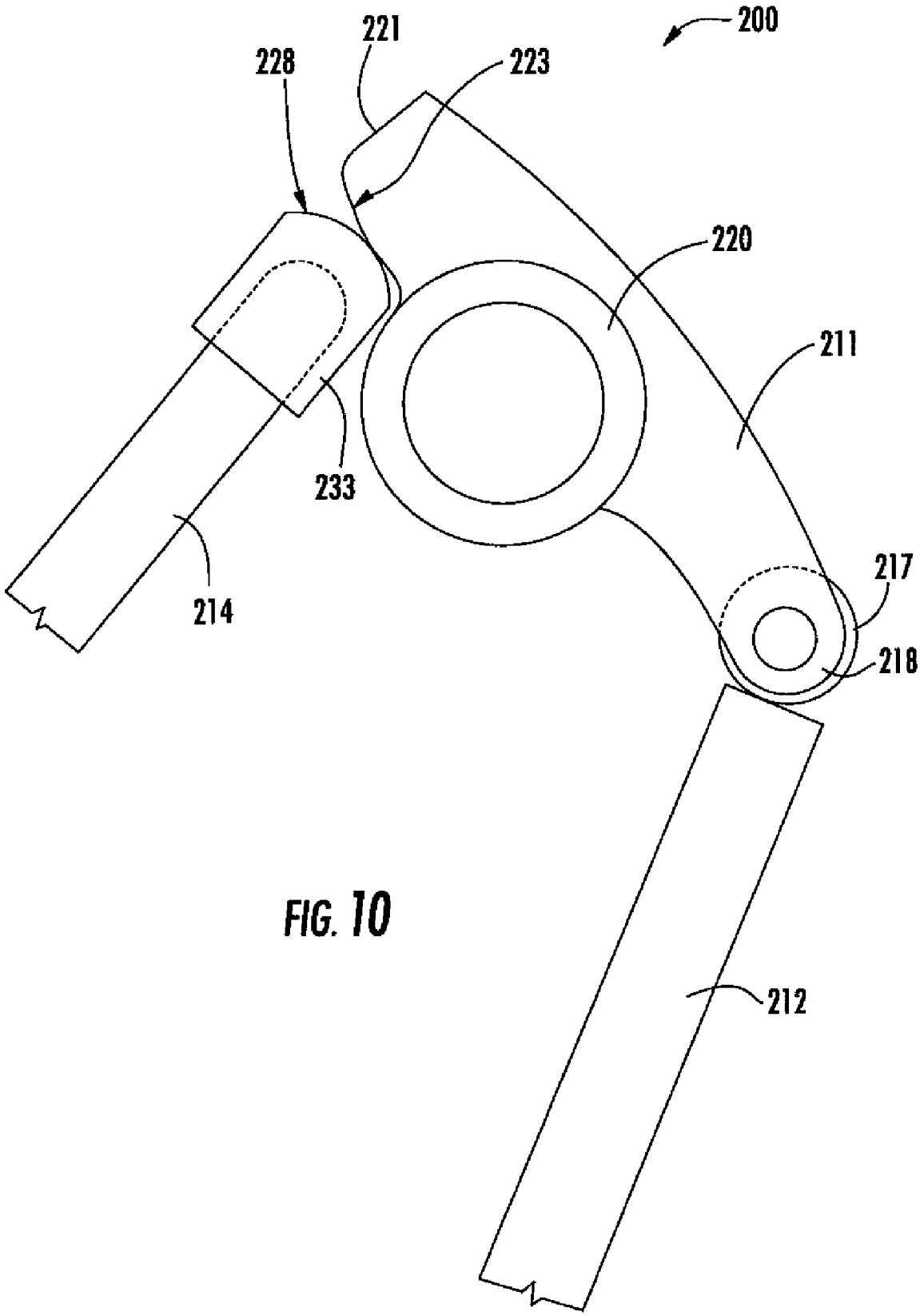
FIG. 10 shows the rocker assembly of FIG. 9 at maximum lift.

Referring to FIGS. 9 and 10, a rocker assembly according to another embodiment of the invention is shown at reference numeral 200. Like rocker assembly 10, the rocker assembly 200 includes a rocker arm 211 with a roller 217 positioned on a first free end 218, a trunnion 220 positioned between the first free end 218 and a second free end 221; and a push-rod 214. A radiused follower, such as lifter 233, having a top 228 with a convex curvature is positioned on the push-rod 214 for interacting with a radiused bottom edge 223 of the second free end 221 to variably lift the rocker arm 211 from a closed position, FIG. 9, to an open position, FIG. 10, thereby causing a valve 212 to open.

A rocker assembly is described above. Various details of the invention may be changed without departing from its scope. Furthermore, the foregoing description of the preferred embodiments of the invention and best mode for practicing the invention are provided for the purpose of illustration only and not for the purpose of limitation.

I claim:

1. A variable ratio rocker assembly, comprising:

(a) a rocker arm adapted to move a valve between a closed position and an open position;

(b) a radiused follower adapted to interact with a portion of the rocker arm, wherein the follower causes the rocker arm to move the valve between the closed position and the open position; and (c) a push rod for moving the follower in response to a camshaft, such that when the pushrod moves upwardly to move the follower and cause the rocker arm to move the valve to the open position, a contact point between the follower and the rocker arm moves along the rocker arm towards a center of the rocker arm to variably increase a lift ratio of the rocker assembly.

2. The variable ratio rocker assembly according to claim 1, wherein the rocker arm includes a roller on a first free end of the rocker arm for interacting with a stem of the valve to reduce friction between the rocker arm and the valve when moving the valve between the closed position and the open position.

3. The variable ratio rocker assembly according to claim 1, wherein the rocker arm includes a trunnion positioned between a first free end and a second free end of the rocker arm for pivotally supporting the rocker arm on a rocker bar.

4. The variable ratio rocker assembly according to claim 3, and further including a rocker stand for supporting the rocker bar.

5. The variable ratio rocker assembly according to claim 4, wherein the follower is pivotally connected to the rocker stand.

6. The variable ratio rocker assembly according to claim 1, wherein the rocker arm includes a second free end having a radiused bottom.

7. The variable ratio rocker assembly according to claim 6, wherein a top of the follower interacts with the bottom of the second free end to provide a variable lift ratio to the rocker arm.

8. The variable ratio rocker assembly according to claim 7, wherein the top of the follower has a convex curvature.

9. The variable ratio rocker assembly according to claim 1 , wherein the follower includes a receiving cup for receiving an end of the push rod.

10. The variable ratio rocker assembly according to claim 1, and further including a linkage for connecting the rocker arm to the follower.

11. The variable ratio rocker assembly according to claim 10, wherein a first end of the linkage is connected to a trunnion of the rocker arm and a second end of the linkage is connected to the follower to allow the follower and rocker arm to move relative to each other.

12. The variable ratio rocker assembly according to claim 1, wherein the follower is a swing arm.

13. The variable ratio rocker assembly according to claim 1, wherein the follower is a lifter.

14. A variable ratio rocker assembly, comprising:

(a) a pushrod;

(b) a follower actuated by the pushrod in response to a camshaft; and (c) a rocker arm actuated by the follower for moving a valve between a closed position and an open position;

(d) wherein the follower includes a radiused top for interacting with a bottom of a second free end of the rocker arm such that when the follower is actuated to cause the rocker arm to move the valve from the closed Position to the open position, a contact Point between the follower and the second free end of the rocker arm moves along the bottom of the second free end towards a center of the rocker arm to variably increase the lift ratio of the rocker arm.

15. The variable ratio rocker assembly according to claim 14, wherein the rocker arm includes a trunnion positioned between the first free end and the second free end of the rocker arm to allow the rocker arm to pivot about a support.

16. The variable ratio rocker assembly according to claim 14, wherein the follower is pivotally connected to a support.

17. The variable ratio rocker assembly according to claim 14, wherein the bottom of the rocker arm is radiused.

18. The variable ratio rocker assembly according to claim 14, wherein interaction between the top of the follower and the bottom of the second free end creates a variable lift ratio.

19. The variable ratio rocker assembly according to claim 15, and further including a linkage for connecting the rocker arm to the follower, wherein a first end of the linkage is connected to the trunnion of the rocker arm and a second end of the linkage is connected to the follower to allow the follower and rocker arm to move relative to each other.

20. A variable ratio rocker assembly, comprising:

(a) a rocker arm adapted to move a valve between a closed position and an open position, the rocker arm being mounted for pivotal movement about a support and includes:

(i) a first free end for actuating the valve; and (ii) a second free end having a convex bottom portion;

(b) a follower having a convex top portion adapted to interact with the convex bottom portion to provide a variable lift ratio to the rocker arm;

(c) a linkage for connecting the rocker arm to the follower, wherein a first end of the linkage is connected to a trunnion positioned between the first free end and second free end of the rocker arm and a second end of the linkage is connected to the follower to allow the follower and rocker arm to move relative to each other; and (d) a push rod for moving the follower such that the convex top portion moves along the convex bottom portion, thereby causing the rocker arm to pivot about the support and allow the first free end to move the valve between the closed position and the open position.

* * * * *